US005113625A

United States Patent [19]

Davis

[11] Patent Number: 5,113,625

[45] Date of Patent: May 19, 1992

[54] NON-CUMBUSTIBLE MODULAR BUILDING

[75] Inventor: John M. Davis, Elkhart, Ind.

[73] Assignee: Miller Structures, Inc., Elkhart, Ind.

[21] Appl. No.: 622,819

[22] Filed: Dec. 3, 1990

[51] Int. Cl.[5] ..... E04B 1/00

[52] U.S. Cl. ..... 52/143; 52/336

[58] Field of Search ..... 52/143, 336, 630

[56] References Cited

U.S. PATENT DOCUMENTS 508,502 11/1893 Crittenden et al. ..... 52/336

1,995,573 3/1935 Matthews ..... 52/143

*Primary Examiner*—David A. Scherbel

*Assistant Examiner*—Lynn Wood

*Attorney, Agent, or Firm*—Thomas J. Dodd

[57] ABSTRACT

A modular building formed from non-combustible materials which includes a support frame. The frame includes subflooring with a connected concrete pan which allows the concrete floor to be directly into the frame. The building also includes roof edge supports for connecting beams which allow two or more buildings to be joined to form a single complex.

4 Claims, 4 Drawing Sheets

NON-CUMBUSTIBLE MODULAR BUILDING

SUMMARY OF THE INVENTION

This invention relates to modular buildings, and will have appplication to a prefabricated building which is transportable from the factory to the building site.

Prefabricated non-combustible buildings are typically constructed with aluminum, concrete and steel frames and non-combustible side and top walls. Previous buildings of this sort are shown in the patents which accompany the enclosed prior art sheet. In all of the prior buildings, the flooring material consists of either a single concrete slab which overlies and is supported atop the sub-floor framing, or multiple slab units which are formed prior to their installation in the frame. All of these constructions require that the concrete be at least four inches in thickness to provide adequate load support.

Further, all previous buildings were constructed as stand alone units and did not readily adapt to use within a multiple unit configuration.

The non-combustible building of this invention includes a concrete pouring pan built directly into and integral with the sub-floor framing. When used with a reinforced concrete mix, this construction allows the concrete to be poured directly into the sub-flooring and at a minimum depth of one-and-a-half inches. This concrete flooring system allows the floor to be finished and smoothed very quickly and eliminates the need for tolerances on the size of the prepoured slabs.

Further, the building of this invention includes specially designed top edge sections and adapts readily to connection with other buildings of its kind. By inserting a gap closure piece at the roof junction, two or more buildings can be joined to form a complex.

Accordingly, it is an object of this invention to provide for an improved non-combustible prefabricated building.

Another object is to provide for a non-combustible building which can be assembled more rapidly than previous buildings.

Another object is to provide for a non-combustible building which provides for a stronger, more compact flooring system which weighs less.

Another object is to provide for a non-combustible building which is easily adated to connect with other buildings to form a complex.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
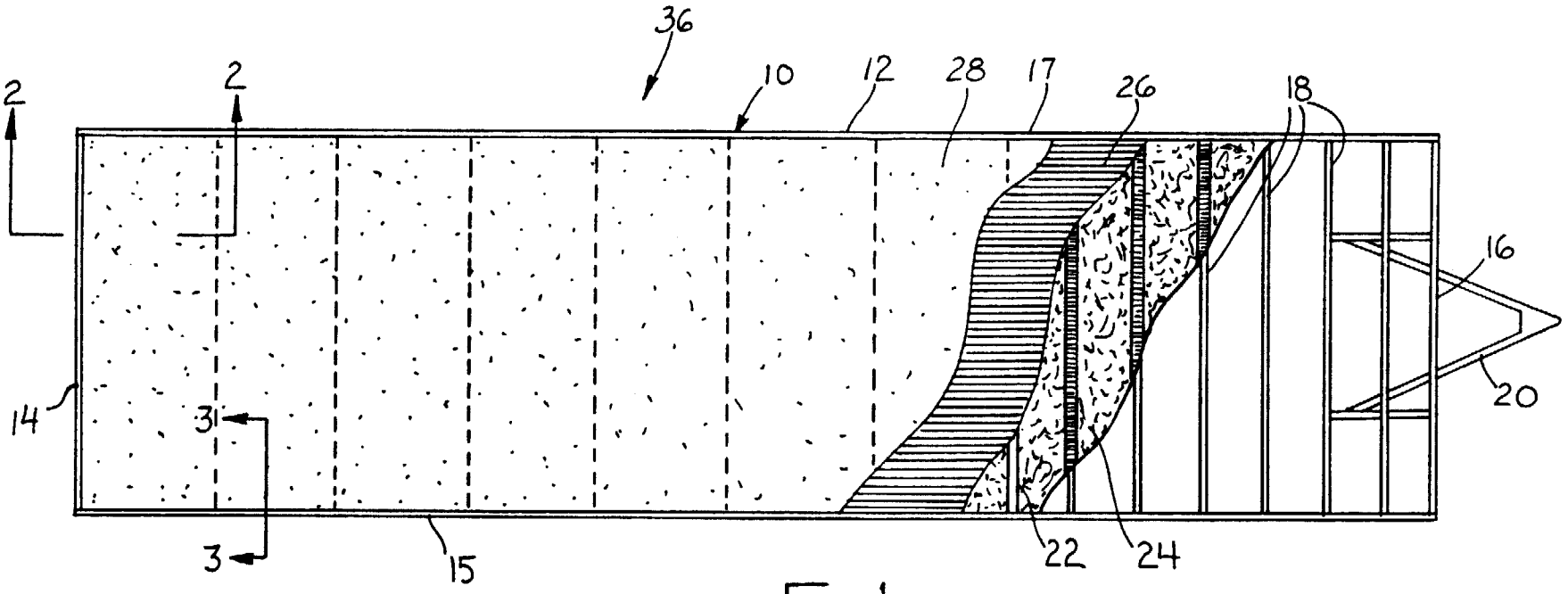
FIG. 1 is a top plan view of the floor of the modular building of this invention with portions cut away for illustrative purposes.

The preferred embodiment herein described is not intended to be exhaustive or to limit the invention to the precise form disclosed. It is chosen and described to explain the principles of the invention and its application and practical use to enable others skilled in the art to utilize the invention.

FIGS. 1–4 illustrate the novel floor system 10 used in conjunction with a modular building 36. Floor system 10 includes a framework 12 comprised of main support beams 14, 15, 16, 17 and a plurality of parallel oriented cross beams 18 spanning beams 14, 15 and connected thereto as by welding. Framework 12 may also include tongue 20 which is removably fastened to framework 12 and allows for connection to a towing vehicle (not shown). Road travel is accommodated by a removable wheel carriage (not shown) fastened to framework 12.

Figure 4:
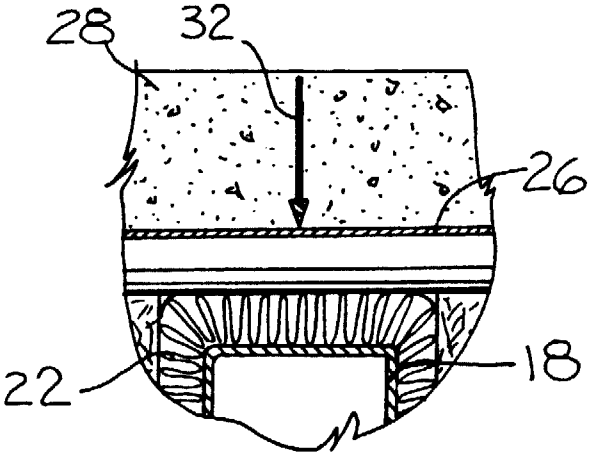
FIG. 4 is a detail view of the floor section seen in circle 4 of FIG. 2.
Figure 3:
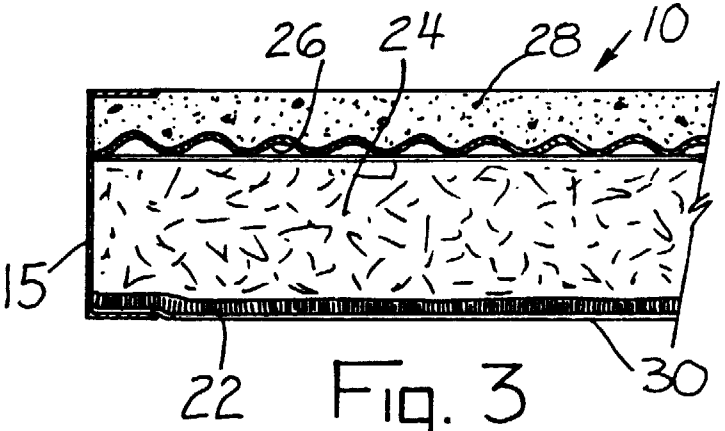
FIG. 3 is a fragmented cross-sectional view taken along line 3—3 of FIG. 1.
Figure 2:
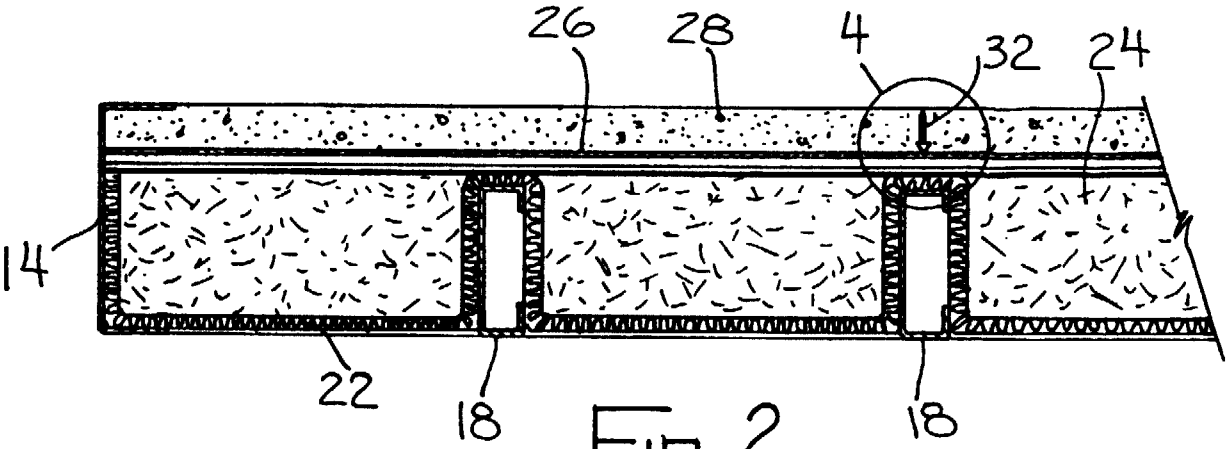
FIG. 2 is a fragmented cross-sectional view taken along line 2—2 of FIG. 1.

Floor system 10, shown in cross-section in FIGS. 2–4 includes a formed pan 22 of suitably strong rigid non-combustible material such as fiberglass, gypsum or similar materials or alloys. Pan 22 is substantially continuous and abuts against support beams 14–17 as shown in FIG. 2. Pan 22 overlies and contacts parallel cross beams 18 as shown to define compartmentalized open areas which are filled with insulative material 24, preferably fiberglass, batt, foam, or other acceptable insulation. Material 24 is preferably filled level with the upper edges of pan 22.

Corrugated metal sheet 26 overlies the upper edge of insulation 24 with the corrugations preferably oriented perpendicular to the longitudinal dimension of beams 18 to allow the cross beams to provide support therefor. Sheet 26 may be fastened to support beams 14–17 as by welding.

Concrete 28 in a pourable state is poured atop sheet 26 to a level even with the top of beams 14–17 and smoothed to a level finish. Concrete 28 is preferably a reinforced mixture capable of withstanding high stress loads and forms floor base 30. Joints are formed in wet concrete 28 by splitters 32 every few feet to allow free expansion of the concrete without cracking as it hardens. The concrete 28 is preferably poured to a final thickness of about 1½ inches which is less than half as thick as floors formed in standard floor systems. Floor covering (not shown) is typically laid atop concrete 28 to define the finished floor.

Figure 5:
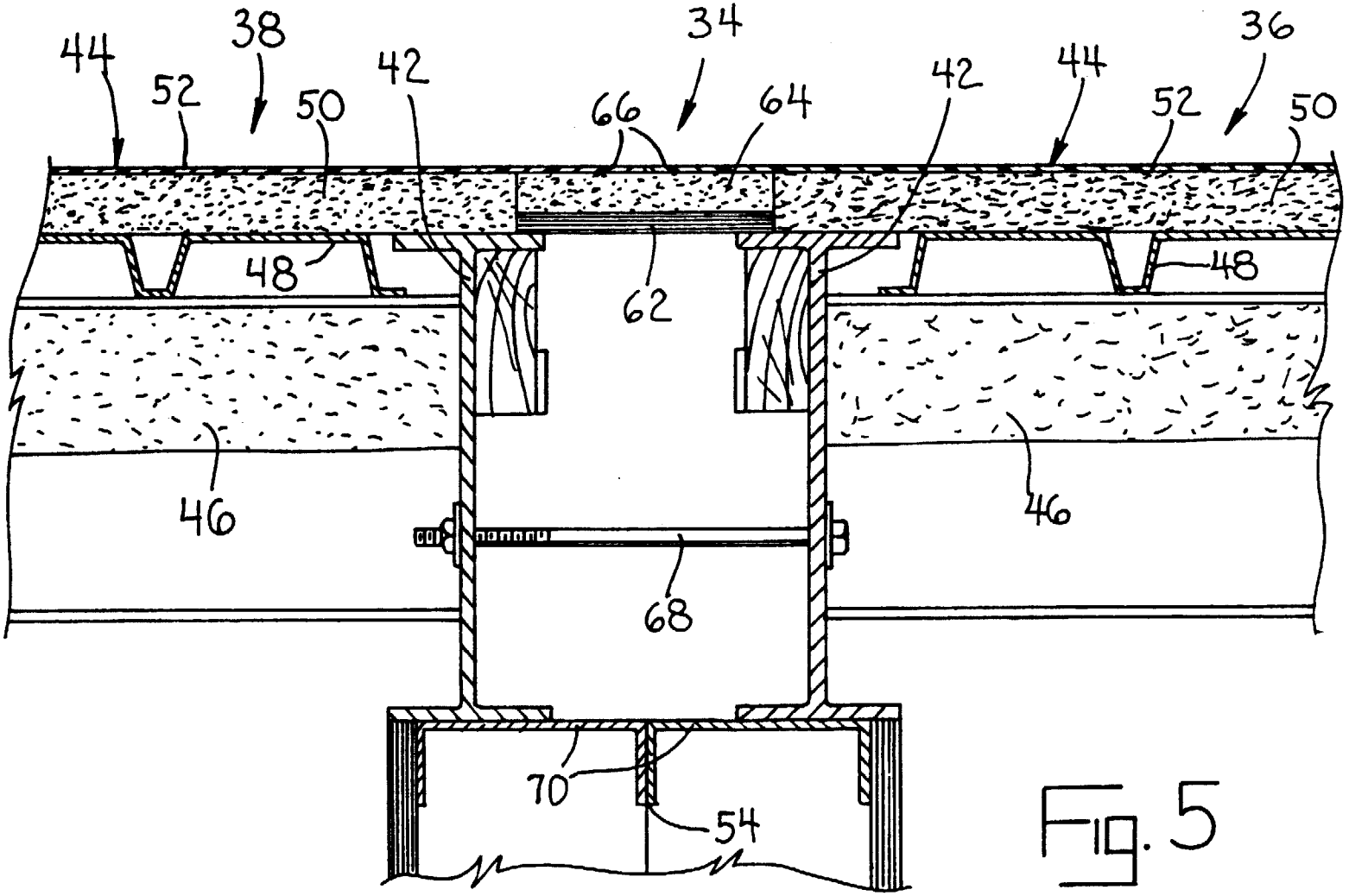
FIG. 5 is an elevation view of building frames showing the connection thereof to form a complex.
Figure 6:
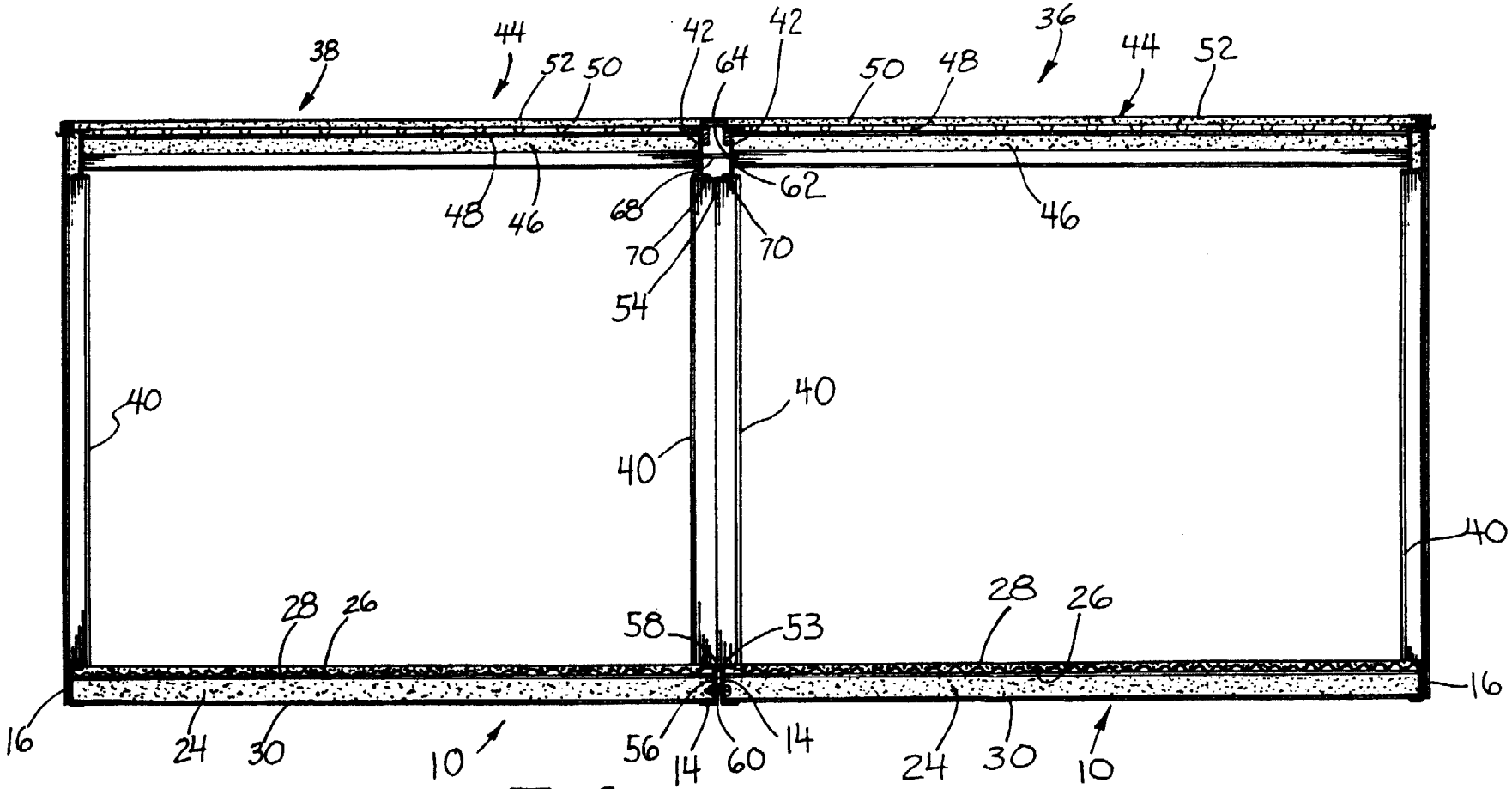
FIG. 6 is a detail view of the roof showing the junction of two buildings by the joining system of this invention.

FIGS. 5 and 6 depict the building connection unit 34 which allows two or more (two shown) buildings 36, 38 to be connected to form a complex. Since each building 36, 38 is of similar construction only one building 36 will be described here with the understanding that the construction of building 38 is substantially the same.

Building 36 includes a plurality of vertical support beams 40 attached to floor framework 12 as by welding. Roof support beams, shown as I-beams 42 are connected to beams 38 as by welding and oriented as shown. A plurality of cross beams (not shown) span beams 42 to complete the roofing framework. Roof 44 is of conventional construction and includes tapered insulation 46 which is overlaid by roof decking 48, insulation 50 and roof covering 52.

When two or more buildings 36, 38 are to be joined to form a complex as shown in FIG. 5, floors 10 and roofs 44 must be joined by seams 53, 54 respectively. Floor seams 53, as shown in FIG. 6, includes compressed foam seal 56 and concrete plug 58 laid flush with the upper edge of beams 14. Bolts 60 (one shown) connect beams 14 of buildings 36, 38 to join the buildings.

Roof seam 54, shown in FIG. 5 includes base board 62 formed of wood or the like which overlies and is supported atop roof beams 42 of adjacent buildings 36, 38 as shown. Insulation plug 64 overlies baseboard 62 and is covered by flaps 66 of roofing 52. Bolts 68 (one shown) extend through roof support beams 42 to connect buildings 36, 38 to form a complex. Mate-up beams 70 abut and are connected and sealed about the periphery of the buildings 36, 38 to complete the weather-tight seal between the buildings.

It is understood that the invention is not limited to the scope of the above details but may be modified within the scope of the appended claims.

I claim:

1. In a modular building including a support framework, said framework including a sub-floor frame means defined by intersecting beams for supporting a floor, side walls and end wall frame means for supporting walls, and a roof frame means for supporting a roof, the improvement wherein said sub-floor frame means includes an integral pan fixedly connected to said side wall means and overlying said intersecting beams corrugated metal sheet overlying said pan a quantity of concrete poured over said metal sheet to define a floor surface substantially flush with an upper edge of said beams.

2. The modular building of claim 1 wherein said framework is constructed of non-combustible material.

3. The modular building of claim 1 wherein said side wall and end wall frame means includes vertical corner posts and said roof frame means includes generally horizontal roof beams spanning said corner posts, said roof beams and corner posts defining an exposed outwardly projecting upper lip, a roof connector piece supported on said lip wherein two or more of said buildings may be connected for use as a single building complex.

4. The modular building of claim 1 and a layer of insulative material overlying said sub-floor frame means to define a gap between said pan and said intersecting beams, and a quantity of insulation positioned within said gap.

* * * * *